United States Patent [19]

Fiske et al.

[11] Patent Number: 4,891,681

[45] Date of Patent: Jan. 2, 1990

[54] HARD COPY APPARATUS FOR PRODUCING CENTER FASTENED SHEET SETS

[75] Inventors: John M. Fiske, Medford, Mass.; Robert P. Crandall, Webster, N.Y.

[73] Assignee: Eastman Kodak Company, Rochester, N.Y.

[21] Appl. No.: 281,588

[22] Filed: Dec. 9, 1988

[51] Int. Cl.[4] ..... G03G 15/00

[52] U.S. Cl. ..... 355/322; 355/25; 355/319; 355/324; 271/207

[58] Field of Search ..... 355/24, 25, 322, 324, 355/325, 310, 319; 271/100, 210, 216, 207, 213, 221, 222, 226, 185

[56] References Cited

U.S. PATENT DOCUMENTS

| | | | |
|---|---|---|---|
| 4,126,389 | 11/1978 | Ikeda et al. | 355/13 |
| 4,218,130 | 8/1980 | Satomi et al. | 355/25 X |
| 4,227,275 | 10/1980 | Soderberg | 11/1 R |
| 4,248,523 | 2/1981 | Doi et al. | 355/13 |
| 4,334,765 | 6/1982 | Clark | 271/185 X |
| 4,592,651 | 6/1986 | Oikawa et al. | 355/72 |
| 4,595,187 | 6/1986 | Bober | 270/37 |
| 4,621,966 | 11/1986 | Luperti et al. | 414/43 |
| 4,640,611 | 2/1987 | Ohdake et al. | 355/77 |
| 4,711,554 | 12/1987 | Nishimori | 355/25 X |

*Primary Examiner*—A. C. Prescott

*Attorney, Agent, or Firm*—J. R. Hanway

[57] ABSTRACT

Electrostatographic apparatus for providing bound sheet sets suitable for folding. The sides of the sheet sets are staggered so that, upon folding, the edges become accurately aligned. Staggering is accomplished by progressively cutting the sheets shorter as they are to be positioned in the stack, and aligning the stacked sheets in a trapezoidal shape before stapling the sheets together. Aligning is accomplished by an inclined surface which makes an acute angle of approximately 32° with the flat surface of the sheets. Movement of the images on the sheet is also provided to keep the outside borders on the various sheets equal.

20 Claims, 3 Drawing Sheets

HARD COPY APPARATUS FOR PRODUCING CENTER FASTENED SHEET SETS

BACKGROUND OF THE INVENTION

1. Field of the Invention

This invention relates, in general, to apparatus for providing hard copy outputs, such as copiers, duplicators, and printers and, more specifically, to such apparatus which stacks the output sheets into groups or sets and then binds or fastens the sheets together at their centers.

2. Description of the Prior Art

Several types of machines and devices are used to provide hard copy outputs, usually consisting of sheets of paper or transparencies. Although called copiers, duplicators, printers, and similar names, their function of providing one or more hard copy outputs of a desired page or sheet is basically the same. Once provided, the sheets can be ejected individually or in groups or sets of sheets arranged or bound together. Some types of apparatus perform additional finishing operations upon the sheets, such as folding and trimming.

A desirable final product for particular applications is a bound sheet set which is fastened at the middle of the sheets and folded into booklet form. Machines in the prior art providing such a booklet required trimming of the booklet edges after the folding operation in order to exactly align the edges of the booklet. This is necessitated by the fact that the outer sheets in the folded booklet extend around a larger bending radius and, consequently, the edges of these outer sheets become, upon folding, closer to the fold in the booklet than the more interior sheets.

Another problem associated with folded booklets provided by hard copy apparatus involves the placement of the images upon the sheets. Usually there are two images applied to the sheets before folding, with the images being positioned on each side of the fold line in the sheet and in proper sequence for correct page registration in the completed booklet. When the images for different sheets are positioned the same distance from the edge of the sheets, the image-to-edge distance, or border, changes when the booklet sheets are trimmed at the edges. This is because of the fact that the trimming cuts different amounts from the edges of the sheets, depending upon their distance from the center of the booklet. For example, the outermost sheet would be cut less than the innermost sheet, thus making the image on the outermost sheet farther from the outside edge than the image on the innermost sheet.

Therefore, it is desirable, and it is an object of this invention, to provide hard copy output apparatus which can provide fastened sheet sets suitable for folding without the need to trim the edges to achieve edge alignment. It is also desirable, and it is another object of this invention, to provide hard copy apparatus which can provide fastened sheet sets suitable for folding wherein the image borders will be consistent throughout the various pages of the folded sheet set.

SUMMARY OF THE INVENTION

There is disclosed herein a new and useful system for providing image bearing hard copy sheet sets which are center-bound and ready for folding into booklets. The sheets of a set are of different lengths and the edges of the sheets are aligned in a staggered fashion prior to binding or fastening the sheets together. The sheets are different in length by amounts which make all of the sheet edges align exactly with each other when the sheet set is folded into booklet form.

According to the preferred embodiment of the invention, the sheets are stacked into a trapezoidal shape before the sheets are fastened together. This is accomplished with an inclined or slanted surface, or gate, against which the sheets are aligned. The inclined surface makes an angle with the surface of the sheets of approximately 32° to form the correct shape for sheet sets of any sheet thickness or quantity. Also in the preferred embodiment illustrating the invention, the different length sheets are provided by a continuous roll feed system which is programmed to cut the roll material at different positions according to the placement of the cut sheet into the stack.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1:
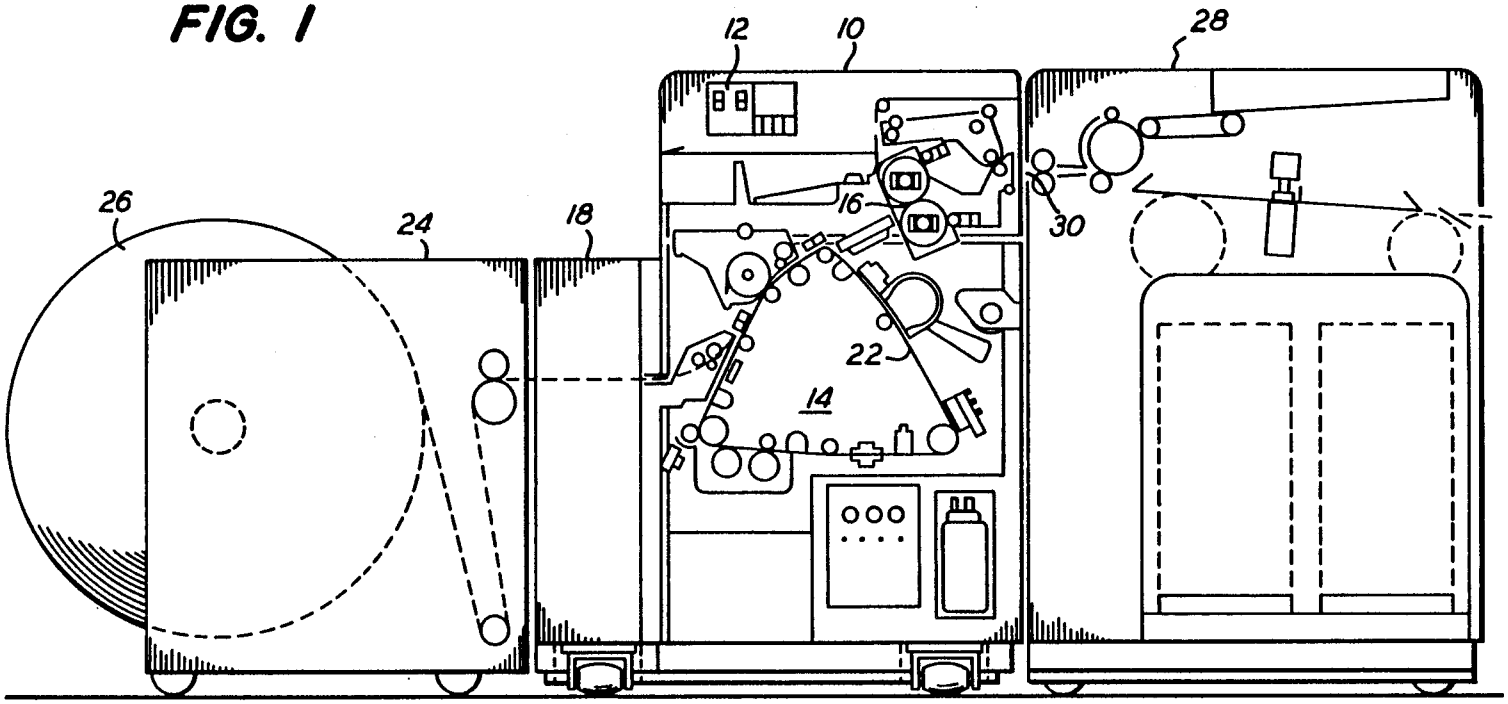
FIG. 1 is a front elevational view of a printer system, partially shown schematically, constructed according to this invention.

Throughout the following description, similar reference characters refer to similar elements or members in all of the figures of the drawing.

Referring now to the drawing, and to FIG. 1 in particular, there is shown a printing machine typical of the type wherein the invention may be used. The printer includes the main printer enclosure 10, the operator control panel 12, the electrostatographic marking engine 14, and the fusing station 16. Areas of electronic circuitry within the printer which control the process are contained within enclosure 18. Operation of the main printer follows conventional state-of-the-art technology, including the use of the photoconductive web 22 as a means for exposing, developing, and transferring images from the original information to the hard copy material.

The printer as shown in FIG. 1 includes the paper supply attachment 24 which contains the paper roll 26. Roll 26 can be a roll of paper having a width of 11" so that both 8½×11" and 11×17" basic paper sizes can be accommodated. A large roll of 36" diameter could supply approximately 30,000 8½" sheets before it would need to be changed. One of the advantages of using such a roll-type feed mechanism is the fact that the sizes of the copy sheets can be easily changed and intermixed simply by properly controlling a cutting mechanism which cuts the roll material at the appropriate positions.

The printer shown in FIG. 1 also includes the stapling attachment 28 which is positioned near the side exit 30 of the printer. This attachment is used to assemble individual sheets coming from the copier into stacks or sets of sheets and staple the sheets together at their centers. The stapling attachment 28 would primarily be used when the output from the copier is to be in booklet form wherein the pages are stapled and folded in the middle and include separate images on each half of the pages. Although shown in FIG. 1 as a combination of three different enclosures each housing the necessary components of the printer, it is within the contemplation of the invention that these same components and functions of the printer may be provided within the same enclosure, partially or completely.

Figure 2:
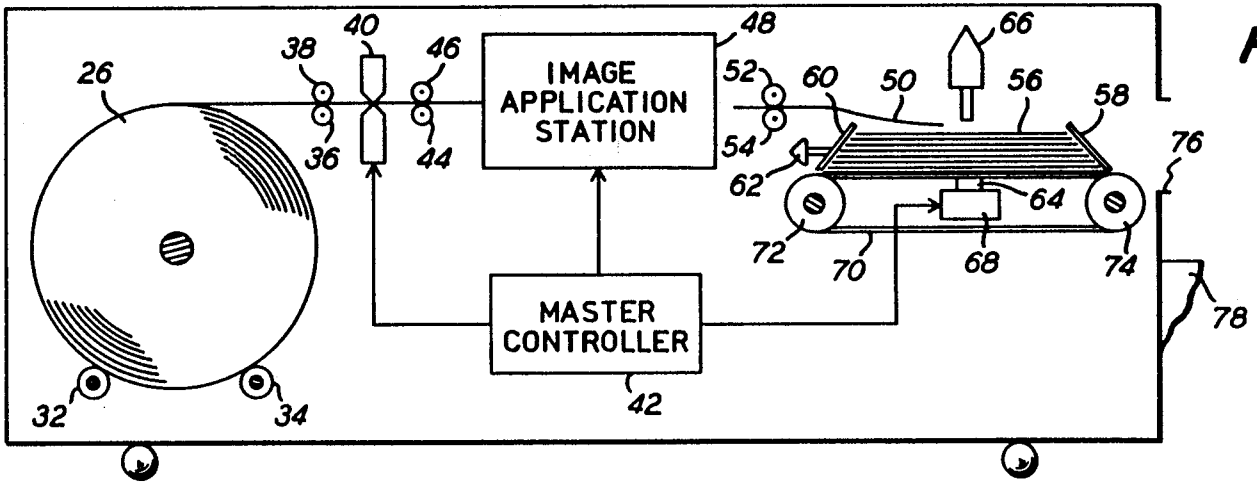
FIG. 2 is a full schematic representation of the printer system shown in FIG. 1 illustrating the features taught by this invention.

FIG. 2 is a schematic representation of the printer shown in FIG. 1 illustrating the important features of the invention. The apparatus of FIG. 2 is included in one enclosure although various components of the apparatus may, as previously stated and within the contemplation of the invention, be contained in separate enclosures. Also, additional functions, such as folding, may or may not be accomplished by suitable means within the apparatus.

According to FIG. 2, the roll of paper 26 is positioned on the rollers 32 and 34 which permit rotation of the roll 26. Other mounting arrangements may be used, such as shaft mounting around the center axis of the roll 26. The material coming from the roll 26, whether it be paper or another material, such as a transparent material, is fed through the feed rollers 36 and 38 to the cutting station 40. The cutting station 40 is controlled by the master controller 42 to appropriately sever the paper to produce sheets of the specified size. The individual sheets are guided by rollers 44 and 46 into the image application station 48 where the image is applied, electrostatographically, to the paper sheet. Application of the image is also controlled by the master controller 42. Since the sheets exiting the image application station 48 are destined to be stapled and folded at their centers to eventually form booklets, the majority of the sheets will include two separate images on each sheet which will be displayed in the finished booklet at different page numbers.

As shown in FIG. 2, the sheet 50 is pushed by the rollers 52 and 54 onto the stack of sheets 56. The edges of the sheets contained in the stack 56 are aligned by the inclined surface, gate, or stop 58. The surface 58 is positioned at an angle with respect to the flat surface of the sheets, thereby causing the edges of the sheets in the stack 56 to be staggered or aligned in an offset pattern as shown in FIG. 2. The other parallel edge of the sheets in the stack 56 are aligned adjacent to the inclined surface 60. Since the sheets contained in the same stack are cut shorter by the cutting apparatus 40, as will be described later herein, the resulting shape of the stack 56 is trapezoidal, with the sides of the stacks being inclined in opposite directions on each side of the stack. The inclined surface 60 may be connected to an electromechanical jogging device 62 which accurately aligns both sides of the stack 56 along the surfaces 58 and 60.

Once the stack 56 is formed, the master controller 42 activates the stapling station 64 which includes the upper section 66 and the lower section 68. Once stapled, the stack 56 is removed from the stapling station by moving the inclined surface 58 out of the way and rotating the conveyor 70 around rollers 72 and 74. This sends the stack 56 through the opening 76 and onto a stacking platform, or tray 78, which is partially shown in FIG. 2. Although inline exiting of the stack 56 may be used as shown in FIG. 2, it is also within the contemplation of the invention that the conveyor system of the apparatus may be such that the stack 56 would be withdrawn from the stapling station 64 perpendicular to the surface of the figure and deposited on a suitable tray or support. In any event, the stapled stack 56 is ready to be folded after it is removed from the apparatus, although it may be convenient, in some applications, to include the folding mechanism within the printing apparatus. Other forms of saddle-stitched fastening besides stapling may be used within the contemplation of the invention.

As previously mentioned, the cutting station 40 is controlled by the master controller 42 to cut the paper sheet material to the proper lengths. For the application indicated herein, it is advantageous to cut the sheets contained within the same sheet set or stack at different lengths. In other words, since the sheet set will eventually be stapled and folded around the center line of the sheets, it is desirable to make the sheets in the stack 56 shorter as they are positioned in the stack closer to the center, or inside, area of the booklet. In order to accomplish this, the master controller 42 starts the bottom sheet, which will eventually be at the outermost position of the booklet, at the largest length, then progressively cuts the sheets going into the same stack slightly shorter each time a sheet is cut. As will be explained later, the amount of change in paper length per page depends upon the thickness of the paper. The beginning sheet of the stack is the longest, and subsequent sheets in the same stack are cut progressively shorter.

The reasoning behind such a progressively shorter cutting is the fact that the booklet, when folded, bends the different pages of the booklet around different radii, therefore changing the length of the sheets along each side of the booklet face. Without the progressive change in sheet length provided by this invention, such a stacking, binding, and folding operation would cause the edges of the booklet to not be in perfect perpendicular alignment and trimming of the edges is customarily required. However, because of the staggered cutting arrangement provided by this invention, the completed and folded sheet sets have their edges in exact alignment, and additional trimming is not required.

Figure 3:
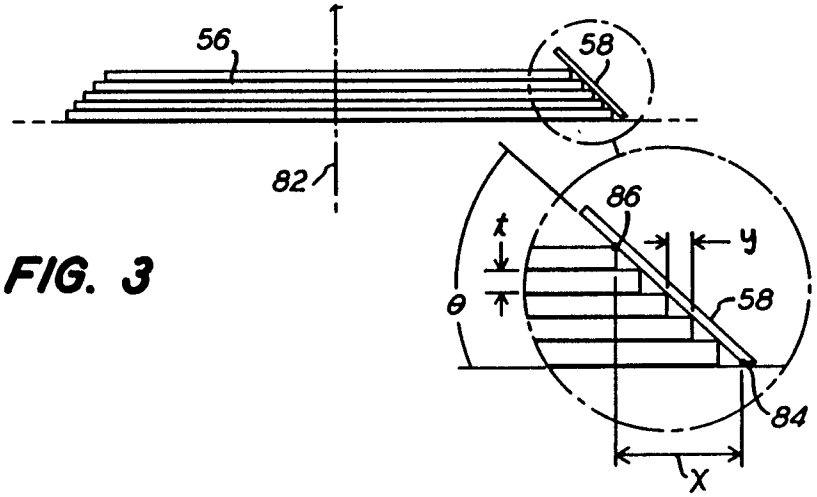
FIG. 3 is an enlarged view of the stacking station shown in FIG. 2.

FIG. 3 is an enlarged view of the stacking station shown in FIG. 2 specifically illustrating the alignment of the sheets of the stack with the inclined surface 58. Alignment of the sheets with the inclined surface 58 is provided by the resting of the edge of the paper sheets against the inclined surface 58. These edges of the paper come into engagement with the inclined surface either because of the forward motion limitation provided by the surface 58 to the individual sheets, or because of the jogging action provided by the other inclined surface, which is not shown in FIG. 3, or by a combination of both methods for pushing the sheets up against the inclined surface 58. Once the sheets are stacked and aligned, and then stapled along the center of the stack, which is illustrated at line 82, the inclined surface 58 is rotated or moved, by a suitable mechanical apparatus in the copier, to permit the exit of the stapled stack 56 from the stapling station.

The enlarged portion of FIG. 3 illustrates the paper edge locations which are staggered against the surface 58 to form a side of the stack which is inclined at the same angle as the surface 58. This angle is determined by calculations based upon the thickness of the paper involved and the number of sheets in the stack. However, as the following explanation illustrates, the angle of the inclined surface 58, and consequently the angle of the side of the stack 56, is constant regardless of the thickness and number of sheets in the stack, thereby permitting the inclined surface to be uniquely oriented at a fixed angle regardless of the number of sheets or the thickness thereof used to form the sheet stack 56. By similar reasoning, the inclined surface 60, shown in FIG. 2, would form the same acute angle with the flat surface of the sheets as does the inclined surface 58.

Figure 4:
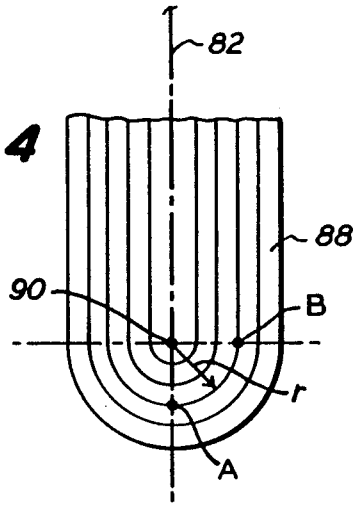
FIG. 4 is a partial view of a folded sheet set showing the area near the center of the sheets.

Again referring to the enlarged portion of FIG. 3, the angle $\theta$ can be determined by the geometric constructions shown in FIGS. 3 and 4. The angle $\theta$ is determined by the equation:

$$\tan\theta = Nt/x, \tag{1}$$

where N is the number of sheets or pages in the stack, t is the thickness of each sheet, and x is the horizontal dimension shown in FIG. 3 between points 84 and 86. Although the illustrated examples show a stack set containing five sheets, the formulas used to develop the angles and dimensions pertinent to this invention are developed for the generalized case of an N number of sheets in the stack.

The distance x can be determined by an analysis of the diagram shown in FIG. 4. FIG. 4 illustrates the folded area of the sheet set after it has been stapled and folded between the line 82. As can be seen in FIG. 4, the outermost sheet 88 requires a longer distance to bend around the center of curvature point 90 than the interior sheets of the stack. The distance required for the curvature portion of the sheet on one side of the booklet can be represented by the equation:

$$D_{AB} = 2\pi r/4, \tag{2}$$

where $D_{AB}$ is the distance between points A and B along the arc of curvature illustrated, and r is the radius of such curvature. This formula is basically one-fourth the circumference of a circle having a radius of r. By substituting the relationship between the radius, the thickness of the sheets, and the number of the sheets, the generalized expression for equation (2) becomes:

$$D_{AB} = 2\pi Nt/4. \tag{3}$$

The arced distances provided by formula (3) are related to the distances by which the individual sheets fail to line up at their edges when folded into a booklet unless special paper trimming has been accomplished. In other words, the outermost sheet shown in FIG. 4 would be shorter than the innermost sheet at the edges thereof by an amount equal to the difference between the arced distances for the curvature of the two different sheets. The distance x, shown in FIG. 3, is the arc distance of an N+1 sheet minus the arc distance of the first or innermost sheet of the stack. This is represented by the equation:

$$x = 2\pi(N+1)t/4 - 2\pi t/4, \tag{4}$$

which can be simplified to:

$$x = \pi Nt/2. \tag{5}$$

The tangent of the angle $\theta$ is a function of the distance x and the total height of the stack, or Nt. Thus, the equations (6) and (7) are used to determine the acute angle of the inclined surface with the flat surface of the sheets.

$$\tan\theta = 2Nt/\pi Nt = 2/\pi, \tag{6}$$

$$\theta = 32.48°. \tag{7}$$

Thus, it can be seen that, regardless of the number of sheets in the stack 56, the inclined surface 58 would be positioned at an acute angle of approximately 32° with respect to the horizontal plane containing or supporting the sheet stack 56. Inclined surface angles appreciably greater than 32° or appreciably less than 32° would not align the stack of sheets in a trapezoidal shape which is required so that when the sheets are stapled and folded, the edges are in exact alignment. Although 32° provides the desired angle, some slight departure from 32° may still produce satisfactory results and some variation from 32° is within the contemplation of this invention. The tightness of the stack of sheets during alignment can also affect the optimum angle for the inclined surface 58.

In addition to the angle of the inclined surface 58, FIG. 3 can be used to determine the length of the individual sheets of the stack to provide the staggered relationship necessary to give the ultimate result of aligned edges after folding. Distance y, shown in FIG. 3, represents the shortened distance between two adjacent sheets on one side of the stack. The total distance would be twice this amount, and would be consistent for all of the sheets within the stack. Distance y and the thickness of the sheets are related to the tangent of the angle of the inclined surface by the equation:

$$\tan\theta = t/y. \tag{8}$$

Rearrangement and substitution of the value of the tangent of $\theta$ provides the following:

$$y = t/\tan\theta = t\pi/2. \tag{9}$$

Since the total sheet length or dimension shortness is twice the y value shown in FIG. 3, the overall sheet shortness dimension is provided by:

$$2y = t\pi. \tag{10}$$

Thus, it can be seen that the sheets of the stack are shorter depending upon the thickness of the individual sheets. Ordinarily, the master controller of the system would know when a sheet stack was to begin and would make all of the subsequent sheets, after the first sheet, shorter by the dimension shown in equation 10 until the last sheet of the stack is run through the image application station 48, shown in FIG. 2. It is the combination of both the variable cutting, or providing of different size sheets, and the trapezoidal alignment of the sheet stack before stapling, which allows the imaged, stacked, and stapled sheet set to be folded into booklet form with the edges thereof in exact alignment.

Figure 5:
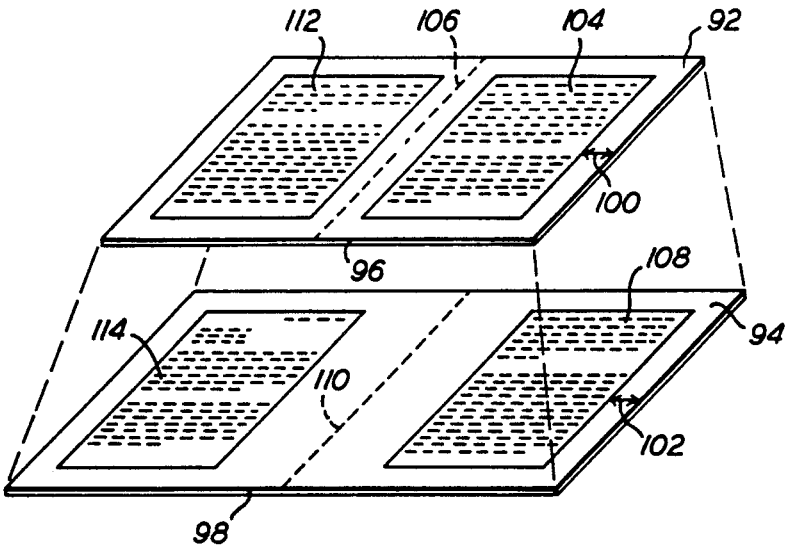
FIG. 5 is an abbreviated view of a stacked sheet set illustrating the placement of the images on the sheets.

FIG. 5 illustrates the two most separated sheets of a sheet set or stack, with the interior sheets not being illustrated. Sheet 92 is the innermost sheet of the folded booklet and the top sheet of the unfolded sheet stack. Sheet 94 is the outermost sheet of the folded booklet and the bottom sheet of the sheet stack. As previously stated, the top sheet 92 would have a shorter dimension along the edge 96 than the sheet 94 has along the edge 98. The difference between the two dimensions, of course, is dependent upon the thickness of the sheets rather than the number of sheets in the stack, assuming that the sheets are thin enough that alignment differences between the thicknesses of the sheets can be disregarded.

Since sheet 92 is shorter than sheet 94, the placement of the images upon the sheet 92 needs to be relocated with respect to sheet 94 in order for the images to appear aligned with the other edges of the sheet. In other words, to keep the border separations 100 and 102 equal, the image 104 must be placed closer to the center line 106 of sheet 92 than the image 108 is placed to the center line 110 of sheet 94. Although shown in FIG. 5 exaggerated to emphasize the shifting of the images to maintain a constant border spacing, the image locations do have to be moved on each sheet of the stack to maintain exact border spacings. A similar discussion of the image placement applies to the images 112 and 114 on the other end of the sheets. An image may consist of text, graphics, pictorial, or other information suitable for deposition on a sheet material.

Figure 6:
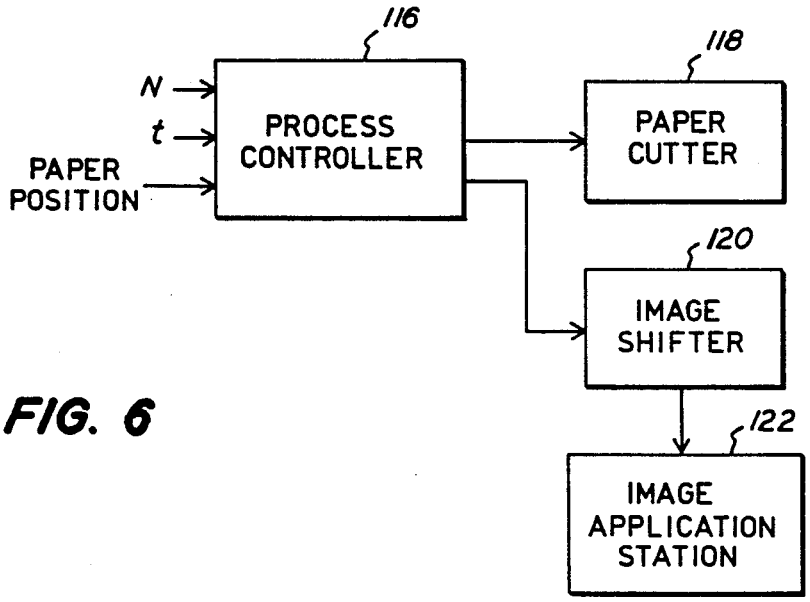
FIG. 6 is a block diagram illustrating the control channels used in practicing the invention in the apparatus of FIG. 2.

Moving the image on the sheets is accomplished by the master controller 42 by determining certain quantities when the images are placed upon the paper. FIG. 6 illustrates, in block form, the controlling of the image location. The process controller 116 is provided with information regarding the number of the sheet in the stack, or the vertical position of the sheet, the thickness of the sheets, and the linear paper position of the sheets through the image application station. Depending upon the relationship between these variables, the paper cutter 118, which is analogous to the cutting station 40 shown in FIG. 2, and the image shifter 120 are controlled to suitably position the images on the paper sheets. Image shifter 120 functions with the image application station 122, which is analogous to the image application station 48 in FIG. 2, to place the image at the proper position on the paper. In other words, the position of the image is determined by the position of the paper within the stack, the thickness of the paper, and, of course, the linear position of the paper within the image application station.

Although described in block form in FIG. 6, the image shifting process also includes conventional methods and apparatus, well known in the prior art, for placing separate images upon the same sheet of paper so that when bound and folded into a booklet, the resulting pages are in proper registration as far as page numbers are concerned. The additional timing and positioning of the apparatus to shift the images upon the paper sheets is for the purpose of maintaining an equal border on the sheets even when the length of the sheets is changed. Varying the timing of writing the image on the moving photosensitive surface is one arrangement which can be used for shifting the images.

There has been disclosed herein a new and useful system and apparatus which systematically cuts, stacks, and fastens sheets of paper in a manner which makes the edges of the booklets formed therefrom in alignment without further trimming being required. It is emphasized that numerous changes may be made in the above-described system and apparatus without departing from the teachings of the invention. It is intended that all of the matter contained in the foregoing description, or shown in the accompanying drawing, shall be interpreted as illustrative rather than limiting.

We claim as our invention:

1. Apparatus for providing bound sheet sets containing a plurality of hard copy sheets having applied images thereon, with the sets being bound together at the center of the sheets, said apparatus comprising:

means for applying the images to the sheets;

means for providing a plurality of sheets to the applying means, with each sheet destined for the same bound sheet set having a different length;

means for stacking the plurality of sheets comprising the same sheet set into a trapezoidal shape with the sides of the stack being defined by edges of progressively shorter sheets stacked together; and means for fastening the stacked sheet set together at the common centers of the sheets.

2. The apparatus of claim 1 wherein the means for applying the images to the sheets includes an electrostatographic device for depositing and fusing toner particles to the sheets corresponding to the desired image.

3. The apparatus of claim 1 wherein the means for providing the plurality of different length sheets comprises:

a continuous roll of sheet material having a fixed width;

controllable means for cutting the sheet material from the roll to provide individual sheets of a specified length; and means for controlling the cutting means so that the roll material is cut progressively in different lengths when the sheets are destined for the same bound sheet set.

4. The apparatus of claim 3 wherein the sheets are cut progressively shorter.

5. The apparatus of claim 4 wherein adjacent sheets are shorter by an amount equal to $t\pi$, where t is the thickness of a sheet.

6. The apparatus of claim 1 wherein the stacking means includes a first inclined surface positioned to contact the sheet edges on one side of the set and to align the centers of the sheets with each other.

7. The apparatus of claim 6 wherein the stacking means also includes a second inclined surface positioned at the other side of the sheet set, said second inclined surface being mechanically driven to jog the sheets into even alignment with said first and second inclined surfaces.

8. The apparatus of claim 6 wherein the first inclined surface forms an acute angle with the flat surface of the sheets of approximately 32 degrees.

9. The apparatus of claim 8 wherein the second inclined surface forms an acute angle with the flat surface of the sheets of approximately 32 degrees.

10. The apparatus of claim 1 wherein the fastening means includes means for stapling the sheets together.

11. Apparatus for providing bound sheet sets containing a plurality of hard copy sheets having applied images thereon, with the sets being bound together at the center of the sheets, said apparatus comprising:

an electrostatographic device for depositing and fusing toner particles to the sheets corresponding to the desired images;

a continuous roll of sheet material having a fixed width;

controllable means for cutting the sheet material from the roll to provide individual sheets of a specified length;

means for controlling the cutting means so that the roll material is cut progressively shorter when the sheets are destined for the same bound sheet set;

means for stacking the plurality of sheets comprising the same sheet set into a trapezoidal shape with the sides of the stack being defined by edges of the progressively shorter sheets stacked together; and means for fastening the stacked sheet set together at the common centers of the sheets.

12. The apparatus of claim 11 wherein the electrostatographic device progressively moves the image on the sheets to compensate for the difference in the size of the sheets, thereby maintaining an equal border around the outer edge of the image.

13. Apparatus for providing bound sheet sets containing a plurality of hard copy sheets having applied images thereon, with the sets being bound together at the center of the sheets, said apparatus comprising:

an electrostatographic device for depositing and fusing toner particles to the sheets corresponding to the desired images;

means for providing a plurality of sheets to the electrostatographic device, with each sheet destined for the same bound sheet set having a different length;

a first inclined surface positioned to contact the sheet edges on one side of the set and to align the center of the sheets with each other;

a second inclined surface positioned at the other side of the set;

a movement producing device connected to the second inclined surface to jog the sheets into even alignment with said first and second inclined surfaces to form the set into a trapezoidal shape; and means for stapling the stacked sheet set together at the common centers of the sheets.

14. The apparatus of claim 13 wherein the first and second inclined surfaces each form an angle with the flat surface of the sheets of approximately 32 degrees.

15. Apparatus for providing bound sheet sets containing a plurality of hard copy sheets having applied images thereon, with the sets being bound together at the center of the sheets, said apparatus comprising:

an electrostatographic device for depositing and fusing toner particles to the sheets corresponding to the desired images;

a continuous roll of sheet material having a fixed width;

controllable means for cutting the sheet material from the roll to provide individual sheets of a specified length;

means for controlling the cutting means so that the roll material is cut progressively shorter by an amount equal to $t\pi$ when the sheets are destined for the same bound sheet set, where t is the thickness of a sheet;

a first inclined surface positioned to contact the sheet edges on one side of the set and to align the center of the sheets with each other, said surface forming an acute angle with the flat surface of the sheets of approximately 32 degrees;

a second inclined surface positioned at the other side of the set, said surface forming an acute angle with the flat surface of the sheets of approximately 32 degrees;

a movement producing device connected to the second inclined surface to jog the sheets into even alignment with said first and second inclined surfaces to form the set into a trapezoidal shape; and means for stapling the stacked sheet set together at the common centers of the sheets;

said electrostatographic device progressively moving the image on the sheets to compensate for the difference in the size of the sheets, thereby maintaining an equal border around the outer edge of the image.

16. A method for producing bound sheet sets having applied images on the sheets, said method including the steps of:

providing a plurality of sheets each having a different length;

applying images electrostatographically to said sheets;

stacking the imaged sheets together to form a sheet set with adjacent sheets in the set having progressively different lengths;

aligning the edges of the stacked sheets with at least one inclined surface to form the stack into a trapezoidal shape with the centers of the all the sheets in common alignment; and fastening the aligned sheets together with a fastening member.

17. The method of claim 16 including the step of jogging the sheets into alignment by the use of another inclined surface.

18. The method of claim 17 wherein the two inclined surfaces each form an acute angle with the flat surface of the sheets of approximately 32 degrees during the alignment of the sheets.

19. The method of claim 16 including the step of progressively moving the images on the sheets to compensate for the difference in the size of the sheets, thereby maintaining an equal border around the outer edge of the image.

20. The method of claim 16 wherein adjacent sheets differ in length by an amount equal to $t\pi$, where t is the thickness of a sheet.

* * * * *